United States Patent [19]

Naeser et al.

[11] 4,147,922

[45] Apr. 3, 1979

[54] DEVICE FOR FIXING A TONER IMAGE

[75] Inventors: Helmut Naeser, Munich; Alban Nusser, Freising, both of Fed. Rep. of Germany

[73] Assignee: Siemens Aktiengesellschaft, Berlin & Munich, Fed. Rep. of Germany

[21] Appl. No.: 851,939

[22] Filed: Nov. 16, 1977

[30] Foreign Application Priority Data

Feb. 15, 1977 [DE] Fed. Rep. of Germany ..... 2706362

[51] Int. Cl.[2] ..... H05B 1/00; G03G 15/20

[52] U.S. Cl. ..... 219/216; 219/347; 219/388; 432/227, 59

[58] Field of Search ..... 432/59; 219/216, 388, 219/347, 349; 432/59, 227, 60, 228; 355/3 FU

[56] References Cited

U.S. PATENT DOCUMENTS

| | | | |
|---|---|---|---|
| 3,207,129 | 9/1965 | Limberger | 219/216 X |
| 3,478,665 | 11/1969 | Umahashi et al. | 219/216 |
| 3,517,164 | 6/1970 | Huggins et al. | 219/216 X |
| 3,772,497 | 11/1973 | Gray et al. | 219/388 X |
| 3,861,863 | 1/1975 | Kudsi | 219/216 X |

*Primary Examiner*—C. L. Albritton

*Attorney, Agent, or Firm*—Hill, Gross, Simpson, Van Santen, Steadman, Chiara & Simpson

[57] ABSTRACT

A preheating saddle for elevating the temperature of a recording carrier upstream of a fixing station in an electrostatic copier or printer. The saddle has heating elements disposed therein in such a manner as to supply the greatest quantity of heat at the upstream end of the saddle while maintaining a constant temperature along the length of the saddle.

17 Claims, 4 Drawing Figures

DEVICE FOR FIXING A TONER IMAGE

BACKGROUND OF THE INVENTION

1. Field of the Invention

This invention relates to a device for use in electrostatic copiers and printers for preheating a paper web prior to a fixing station.

2. Prior Art

This invention relates to that class of device, particularly nonmechanical printers and copiers, in which a data carrier has a toner image applied thereto which is to be fixed thereon. The data carrier generally is passed between two fixing cylinders. At least one of the cylinders is heated. In front of the fixing cylinders, upstream thereof in the direction of movement of the data carrier, a preheating device can be provided. The preheating device may consist of a saddle over which the data carrier is drawn. The data carrier contacts the saddle on a side of the data carrier opposite the side carrying the toner image. The saddle has heating elements disposed beneath the saddle surface contacting the data carrier.

Nonmechanical printers and copiers of this type are well known. See for example U.S. Pat. No. 3,861,863. In such devices toner images corresponding to the characters which are to be printed are produced on a data carrier which may, for example, be a paper sheet or web. Production of the toner images may be by means which produce a charge, or latent, image of the character on an intermediate carrier such as a drum. The latent image may be electrophotographically or electrographically produced on a photoelectric or dielectric surface of the drum. The charge images are developed at a developer station through the application of toner to areas of the intermediate carrier defined by the latent image. The toner images are thereafter transferred at a transfer station to the data carrier. In order to insure that the toner images will not thereafter blur or smear, the toner image is subsequently fused into the data carrier at a fixing station.

Fixing stations for toner image fusing are known. See for example U.S. Pat. Nos. 3,861,863 and 3,324,791. In such known fixing station devices the data carrier is passed between two fixing cylinders. At least one of the cylinders is heated. The combined application of heat and pressure will cause the toner particles to fuse into the data carrier.

In those cases where high printing speeds are utilized, for example paper speeds on the order of 0.7 m/sec., fusing using only the two fixing cylinders may not be sufficient to provide a good quality end product. It has therefore been proposed to provide a preheating device upstream of the fixing cylinders. See for example U.S. Pat. No. 3,861,863. Preheating devices of the proposed sort may consist of a saddle over which the data carrier is drawn with the undersurface of the data carrier, opposite the toner carrying surface, contacting the saddle surface. Heating elements may be positioned uniformly in rows beneath the saddle surface such that the radiated heat from the heating elements will be directed to the underside of the saddle. As a result of this the saddle will be heated and will be able to transfer heat to the data carrier running thereover. In this manner, before the data carrier reaches the fixing cylinders, it will have been preheated to a suitable temperature. When this preheating construction is used, the quantity of heat which has to be transferred from the fixing cylinders to the data carrier to properly fuse the toner image is less than if the preheating device had not been used.

In the known construction of preheating saddles, the heating elements are uniformly distributed beneath the saddle surface. In such constructions it is generally not possible to provide a uniform temperature over the entire saddle. Since the data carrier will have an ambient temperature of, for example 20° C. at the upstream side of the saddle surface, there will be a large temperature differential between the saddle and the data carrier. Therefore a large heat flow will exist at the upstream end of the saddle. The upstream end, in the direction of movement of the paper web is hereinafter referred to as the "data carrier entry" point.

As a result of the temperature differential at the data carrier entry point a relatively large quantity of heat will be withdrawn from the saddle thus cooling the saddle at that point by a relevant amount. However the situation at the point where the data carrier leaves contact with the saddle, on the downstream side of the saddle, it is different. At that point the data carrier has had its temperature substantially elevated such that it is approximately the same as the saddle. Thus there is a relatively small heat transfer between the saddle and the data carrier at the downstream or "data carrier exit" point. As a result the saddle will have a higher temperature at the data carrier exit point then it has at the data carrier entry point.

A further disadvantage of the above described heating devices is the fact that the uniform distribution of the heater elements requires that the saddle be quite large in order to preheat the data carrier to the required temperature.

SUMMARY OF THE INVENTION

It is a principle object of this invention to provide a fixing device for fusing the toner image to a data carrier, which the device includes a preheating member which rapidly heats the data carrier to the desired temperature.

This principle object is achieved by choosing the heat output power of the heating elements and positioning them beneath the saddle in such a manner that the additive sum of the heating power of all of the heating elements is maximized adjacent the data carrier entry point and thereafter decreases towards the data carrier exit point.

In the preferred embodiment, the heating elements can be chosen such that the temperature of the saddle is constant over its full extent from the entry point to the exit point. Ideally the constant temperature can be equivalent to a limiting temperature determined such that even when the data carrier is at a standstill on the saddle, it will not be scorched. In a construction according to the herein described invention, maximum heat transfer from the saddle to the data carrier will result, given the parameters of the limiting temperature.

In order to obtain this kind of result, it is preferred to position the heater elements close together adjacent the data carrier entry point and to increase their spacing interval away from the data carrier entry point and towards the data carrier exit point. Further, it is preferable to position the heating elements closer to the saddle surface adjacent the data carrier entry point while spacing them further from the saddle surface adjacent the data carrier exit point. By adopting this positional arrangement, the heating elements can then have identical heating power.

Further, at least for some of the heating elements, it is preferred to position them close together such that their heat powers vis-a-vis the saddle surface are additive to one another.

Additionally, in order to increase the effect of the heater elements, it is desirable to position reflector elements behind the heating elements spaced from the saddle surface such that the reflector elements will reflect the thermal radiation produced by the heater elements back to the saddle.

Although it is possible to use a single reflector element, it is advantageous to provide at least those heater elements located closest to the data carrier exit point with their own individual reflectors. In such an example, those heating elements positioned away from the data carrier entry point can have their own reflector elements. The reflector elements can be constructed such that their sides reflect the thermal radiation from the heating elements towards the data carrier entry point.

One advantage of this arrangement is that because the arrangement allows a constant saddle temperature, a single temperature sensor can be used in association with the saddle. By use of the temperature sensor, the individual heating elements can be controlled.

It is therefore an object of this invention to provide a preheating saddle for elevating the temperatures of data carriers in nonmechanical printers and copiers wherein the saddle has a data carrier contacting surface which is underlied by a plurality of heating elements, the heating elements being positioned closer to the saddle surface at an upstream end of the saddle surface and further away from the saddle surface adjacent a downstream end of the saddle surface with the heating elements adjacent the upstream end being spaced closer to one another and increasing in relative spacing away from the upstream end towards the downstream end such that the heat quantity available for transfer from the saddle to the data carrier is greatest adjacent the upstream end of the saddle.

It is another object of this invention to provide a preheating saddle for nonmechanical printers and copiers wherein the saddle is underlied by a heating elements arranged and positioned with respect to one another to provide a greater heat output adjacent a data carrier entry point of the saddle then adjacent a data carrier exit point while maintaining a substantially constant overall saddle surface temperature.

Other objects, features and advantages of the invention will be readily apparent from the following description of a preferred embodiment thereof, taken in conjunction with the accompanying drawings, although variations and modifications may be effected without departing from the spirit and scope of the novel concpets of the disclosure, and in which:

DESCRIPTION OF THE PREFERRED EMBODIMENTS

Figure 1:
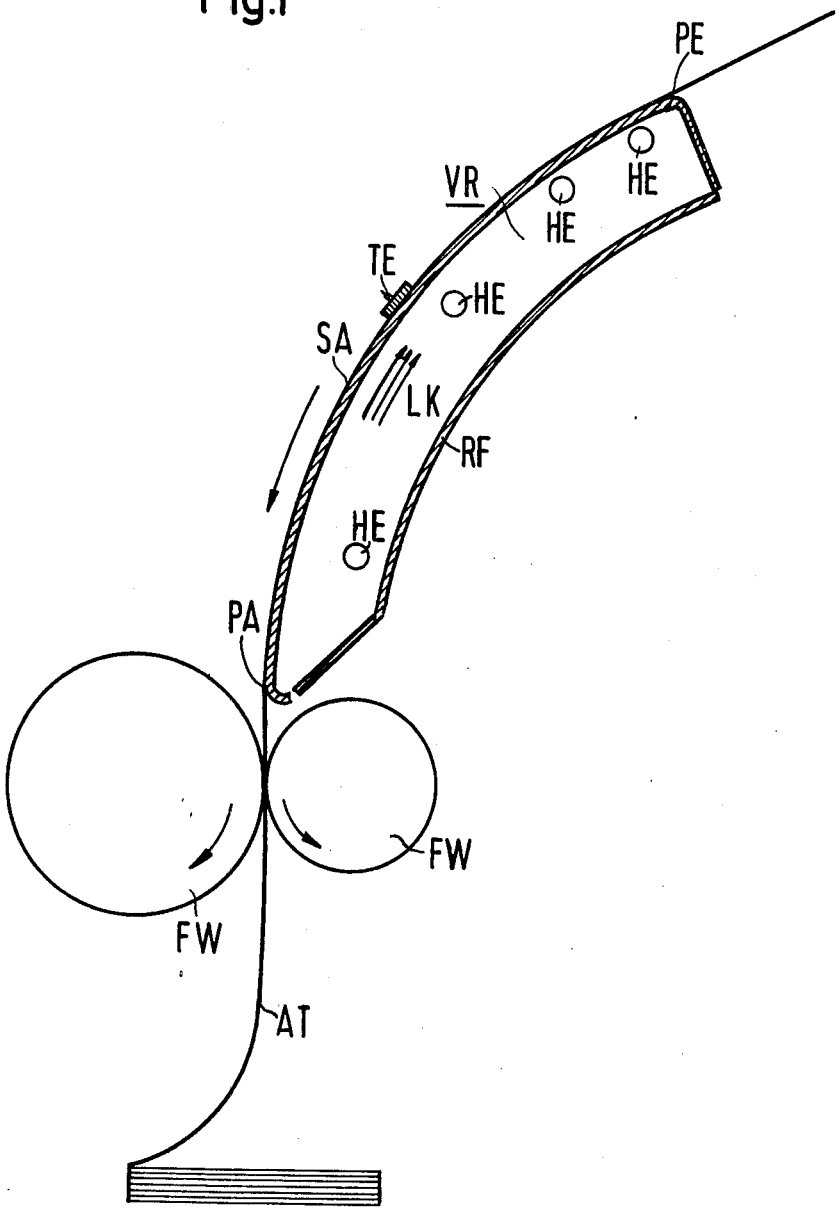
FIG. 1 schematically illustrates, partially in section, a fixing station equipped with a preheating saddle according to this invention.

FIG. 1 illustrates a fixing device according to this invention. The device includes fixing cylinders FW and a preheating device VR. The fixing cylinders FW can be constructed according to known principles such as taught, for example in the aforementioned U.S. Patents. A data carrier AT which is generally a paper strip or web passes between the fixing cylinders FW. By application of heat and pressure by the fixing cylinders a toner image formed on the data carrier is fused into the data carrier.

As viewed in the direction of movement of the data carrier AT, the preheating device VR is positioned upstream of the fixing cylinders FW. The preheat device includes a saddle SA. The saddle SA may be made of metal. Underlying the saddle are heating elements HE. The heating elements can be constructed in a known manner, for example as disclosed in U.S. Pat. No. 3,861,863. The preheating device may also include a reflector element RF underlying the heating elements.

The data carrier has toner images applied to one side thereof and has an undersurface opposite the toner image applied side which contacts the surface of the saddle SA. The data carrier AT contacts the saddle first at a data carrier entry point PE and thereafter slides over the saddle surface being heated in the process and exits the saddle SA at a data carrier exit point PA. From the saddle the data carrier AT is directed immediately to the cylinders FW. A temperature sensor TE can sense the saddle temperature and as a result thereof control the heating power of the heating elements HE.

The use of the preheating device VR is for the purpose of preheating the data carriers so that the heat transfer by the fixing cylinders FW to the data carrier AT can be limited. Examples of saddle and fixing cylinder temperatures are set forth in the disclosure of U.S. Pat. No. 3,861,863.

As shown in FIG. 1 the heating elements HE are not uniformly distributed with respect to the undersurface of the saddle. The heating elements HE are, in fact, positioned more closely together adjacent the data carrier entry point PE. The spacing between adjacent heating elements increases in the direction of the exit point PA. Additionally the heating elements are located closer to the saddle adjacent the data carrier entry point while their spacing from the saddle increases as the heating elements are spaced closer to the data carrier exit point PA.

By means of this spacing of the heating elements below the saddle, a larger total heat power will be available adjacent the data carrier entry point than adjacent the data carrier exit power. This is a desired arrangement due to the fact that the data carrier entry point the temperature differential between the data carrier AT and the saddle is large. Therefore in order to achieve the quickest possible heating of the data carrier, a large heat flow will be required at that point. On the other hand the temperature differential at the data carrier exit point is small, such that there is little, if any, heat flow between the saddle and the data carrier at that point. By means of the illustrated positioning of the heater elements, this desired heat flow arrangement can be accommodated even though the actual heating power of each of the heating elements is the same. Furthermore due to this arrangement, in spite of the fact that differing heat flows are produced at differing areas of the saddle, the saddle can have a constant overall temperature throughout its length.

This constant overall temperature can, in fact, be equal to a limiting temperature. The limiting temperature is determinable as that temperature at which the saddle is not hot enough to scorch the data carrier should the data carrier become stationary against the saddle. By providing this limiting temperature constantly throughout the entire saddle a maximum permisslbe heat transfer from the saddle to the data carrier can be achieved. The limiting temperature, can for example, be approximately 120° C.

Figure 2:
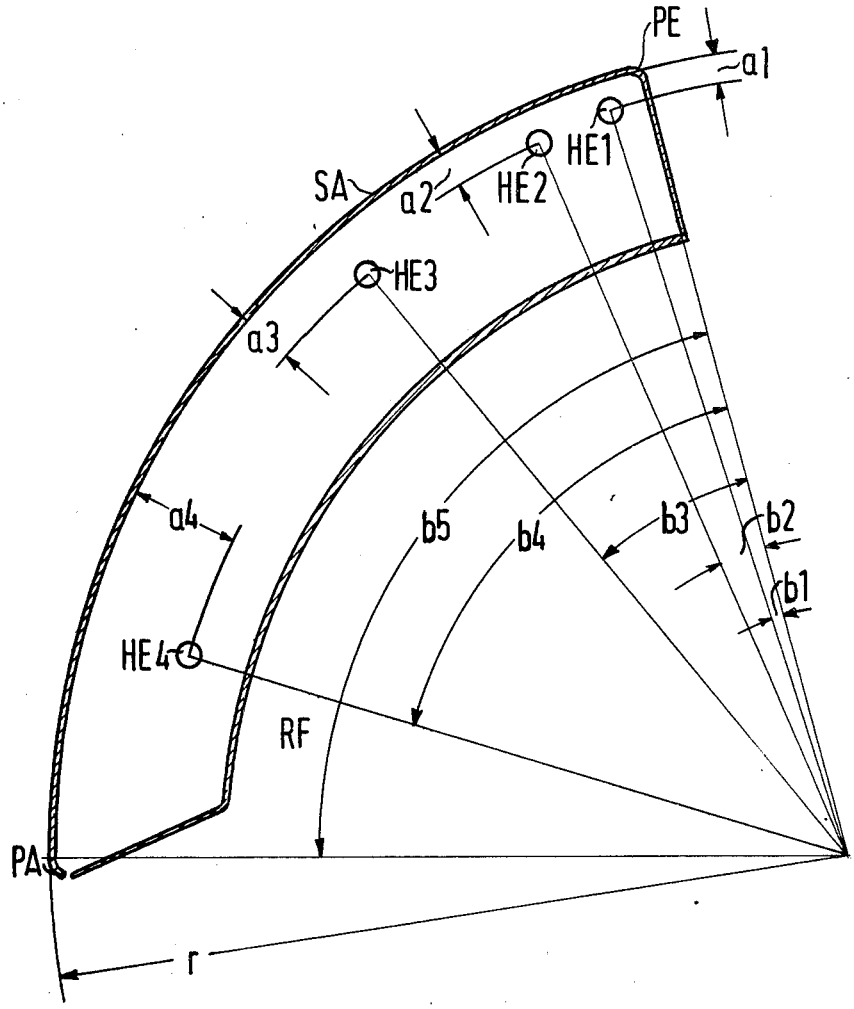
FIG. 2 is an enlarged view of the preheating saddle of FIG. 1 illustrating distribution of the heater elements therein.

A specific example of the positioning of the heating elements is illustrated in FIG. 2. In that construction 4 heating elements, HE1 to HE4 are positioned beneath the saddle SA. The spacing between the saddle undersurface and the heater is indicated at "al" through "a4". For example the spacing a1 may be 34 mm, the spacing a2, 35 mm, the spacing a3, 43 mm, and the spacing a4 56 mm.

The spacing of the individual heater elements HE from one another is indicated in angular units. Beginning with the angular distance of the heating element HE1 from the data carrier entry point PE, the intervals are shown as b1, b2, b3, b4 and the angular distance between the data carrier entry point and the data carrier exit point as b5. In this example the angle b1 may, for example, be 6° the angle b2 may be 16°, the angle b3 may be 30°, the angle b4 may be 47° and the angle b5 may be approximately 57°. In this example the radius r of the saddle surface is approximately 347 mm.

FIG. 2 illustrates a saddle having a heater element spacing according to this invention such that the saddle meets the above described heat transfer requirements.

Figure 3:
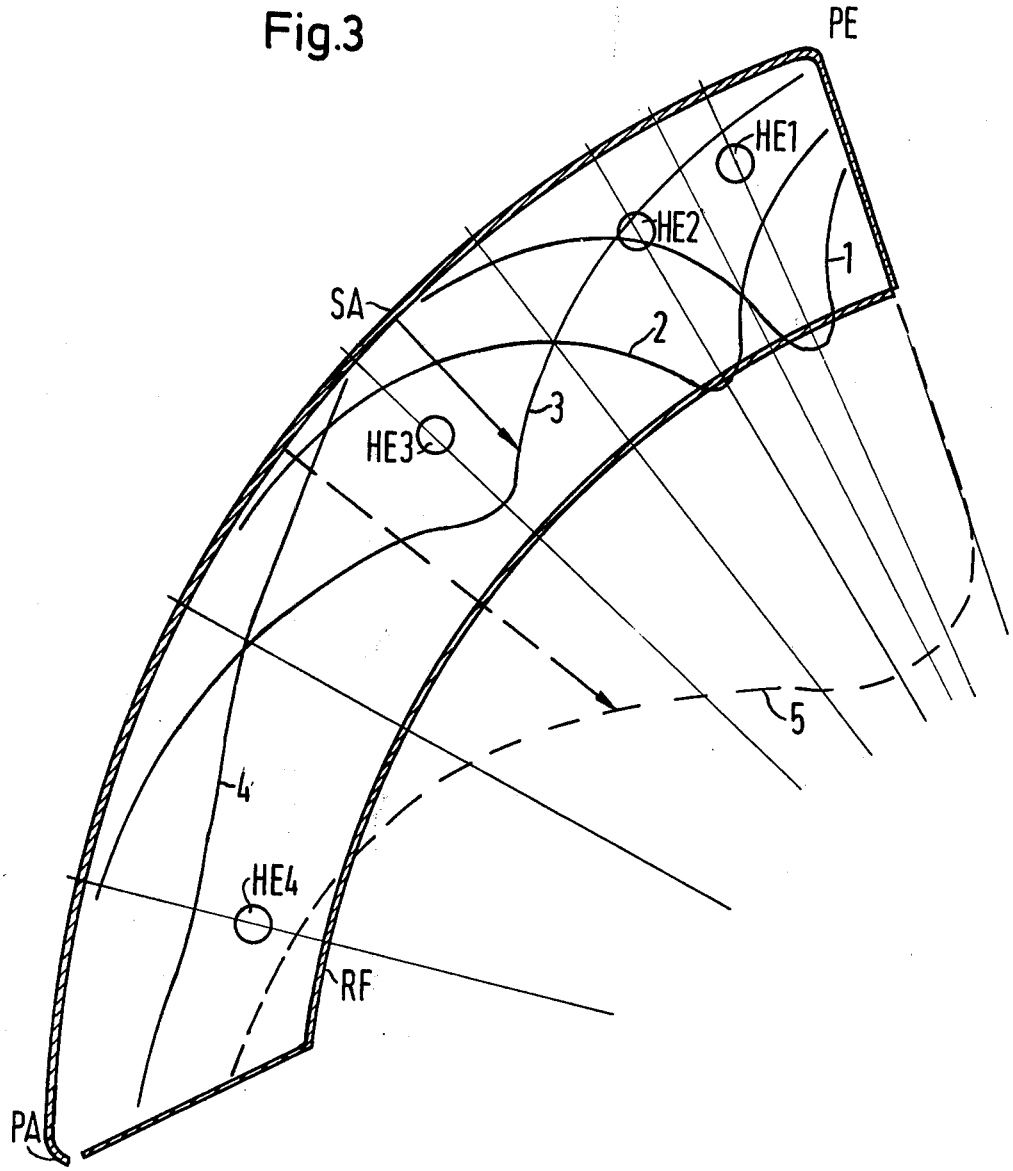
FIG. 3 is a view similar to FIG. 2 diagrammatically illustrating heat power distribution within the saddle.

FIG. 3 illustrates the manner in which the heat output from the individual heating elements HE will be distributed over the saddle surface SA. Curve 1 illustrates the behavior of the heating power of the heating element HE1. Curve 2 indicates the same for the heating element HE2, curve 3 for the heating element HE3 and curve 4 for the heating element HE4. The sum of all heating powers generated by all of the heating elements HE is indicated by line 5 which takes into account the reflected heating power from the reflector RF. Line 5 is illustrated by broken lines.

As shown in FIG. 3, due to the proper positioning and spacing of the heater elements HE beneath the saddle SA, a heat power sum curve can be obtained which provides a maximum value adjacent the data carrier entry point and decreases from that maximum value continously towards the data carrier exit point. This heat distribution pattern is desirable in that it provides the highest heat flowability adjacent the data carrier entry point so as to provide the greatest heat-flow between the saddle SA and the data carrier AT adjacent that point. Heat flow between the saddle and data carrier thereafter decreases towards the data carrier exit point as does the temperature differential between the data carrier and the saddle SA. Although the heat transfer potential is greater at one end of the saddle than at the other end of the saddle, it can be seen by using identical heating elements, the saddle surface will have a temperature which is constant over the entire saddle during operation. Because the data carrier AT will be rapidly heated to the desired temperature, the length of the saddle SA can be maintained relatively short.

A reflector element RF has been provided beneath the saddle SA in each of the embodiments of FIGS. 1 through 3. The reflector reflects thermal radiation from the heating elements back to the saddle SA. The use of the reflector avoids loss of thermal radiation. At the same time the reflector combines with the saddle to provide a closed chamber for the heating elements which thus avoids losses in thermal efficiency due to convection cooling by the ambient air.

The use of a single reflector RF however, has a disadvantage in that within the hollow chamber, formed between the reflector element and the saddle SA, convection air currents can arise. Such air currents are illustrated by the arrows LK of FIG. 1. If data carrier movement suddenly stops, the air convection currents can result in an appreciable temperature rise adjacent the data carrier entry point. This can have the adverse effect of causing scorching of the paper.

In order to eliminate this possible problem, at least those heater elements adjacent the data carrier exit point can be provided with an independent reflector. This will reduce convection currents considerably.

Figure 4:
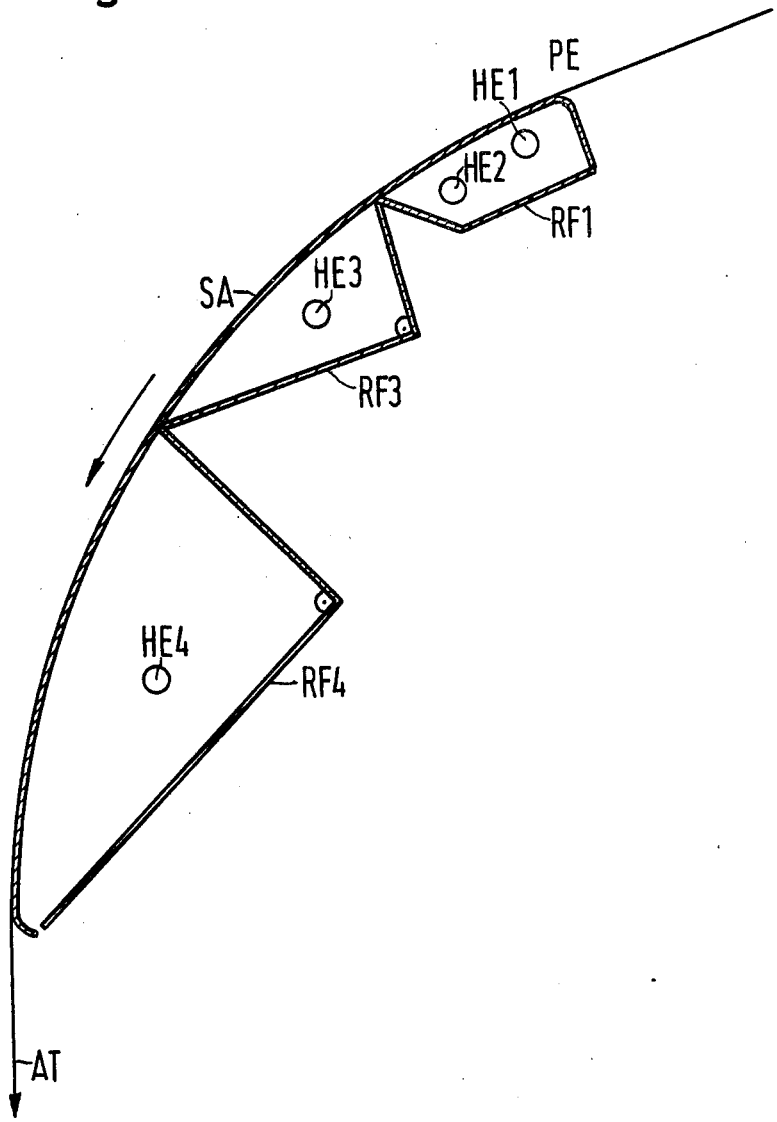
FIG. 4 is a view similar to FIGS. 2 and 3 illustrating positioning of reflector elements.

FIG. 4 illustrates one example of a multi-reflector saddle assembly. In that example the heater element HE4 is provided with its own reflector RF4. Heating elements HE3 is also provided with its own reflector RF3. However heating elements HE1 and HE2 are provided with a common reflector RF1. The reflectors RF4, RF3 and RF1 combine with the saddle SA to form a chamber in which there will be no air convection currents between the adjacent chambers defined by adjacent reflectors. In this manner temperature increase at the data carrier entry point, otherwise caused by air convection, will be eliminated.

Preferably the reflectors RF can be designed such that the thernal radiation produced by the individual heating elements HE will be reflected in the direction of the data carrier entry point.

It will therefore be seen from the above that this invention provides a preheater for data carriers for use in nonmechanical printers and copiers, particularly of the electrostatic type. The preheating device has the following significant advantages: (1) the positioning and spacing of the heater elements provides a rapid and effective heat exchange at the point where the temperature differential between the data carrier and saddle is at its greatest. (2) the uniform temperature along the saddle surface during running of the fixing device will eliminate the possibility of a localized increase in temperature at the data carrier entry point in the event of sudden stoppage of the fixing operation. (3) the uniform temperature distribution over the saddle surface allows the use of a single temperature sensor for uniform control of the heating elements (4) through the use of reflector assemblies such as illustrated in FIG. 4, undesired convection heating at the data carrier entry point is eliminated.

Although the teachings of our invention have herein been discussed with reference to specific theories and embodiments, it is to be understood that these are by way of illustration only and that others may wish to utilize our invention in different designs or applications.

We claim as our invention

1. In a device for fixing a toner images applied to a data carrier by passing the data carrier between two fixing cylinders with at least one of the fixing cylinders being heated, and with a preheating saddle member positioned upstream of the fixing cylinders with the data carrier passing over the saddle and contacting a surface of the saddle on a side of the data carrier opposite a side having the toner image applied thereto with heating elements positioned under the saddle, the improvement: of the heating elements being spaced with respect to the saddle and to one another such that the sum of the heating powers of all of the heating elements is maximized adjacent a data carrier entry end of the saddle and thereafter continuously decreases towards a data carrier exit end of the saddle.

2. The device of claim 1 wherein the temperature of the saddle is maintained at a constant level from the data carrier entry end to the data carrier exit end.

3. A device according to claim 1 wherein the heating elements are positioned relatively close to one another adjacent the data carrier entry end and are spaced from one another at increasing distances towards the data carrier exit end.

4. A device according to claim 3 wherein the heater elements are positioned relatively close to the saddle adjacent the data carrier entry end and are increasingly spaced from the saddle as their position from the data carrier entry end increases.

5. A device according to claim 4 wherein the heater elements are positioned with respect to one another such that their heating powers are additive with respect to the saddle.

6. A device according to claim 5 wherein the heating powers of each of the elements are equal.

7. A device according to claim 6 wherein at least one reflector member is positioned behind the heating elements on a side of the heating elements opposite the saddle, the reflector element effective to reflect thermal radiation from the heating elements to the saddle.

8. A device according to claim 7 wherein at least the heating element positioned closest to the data carrier exit end is provided with a reflector separate from the reflector of the heating elements closest to the data carrier entry end.

9. A device according to claim 8 wherein the reflectors are positioned to direct thermal radiation from the heater elements in the direction of the data carrier entry end.

10. A device according to claim 7 wherein a temperature sensing means is positioned intermediate the data carrier entry and data carrier exit ends of the saddle, the temperature sensing means effective to sense the temperature of the saddle.

11. A device according to claim 7 wherein the reflector and the saddle combine to form a closed chamber in which the heating elements are positioned.

12. A preheating saddle for use in association with fixing stations to preheat a toner image carrying data carrier prior to fixing of the toner image on the data carrier, comprising: a curved surface metal saddle member having a plurality of heating elements disposed to one side thereof, the saddle having a data carrier entry end and a data carrier exit end, the heating elements spaced from one another from the entry end to the exit end, the spacing between adjacent heating elements increasing from the entry end to the exit end, the heating elements being spaced from the saddle, the spacing of the heating elements from the saddle increasing from adjacent the entry end to adjacent the exit end.

13. The device according to claim 12 including reflector means positioned on a side of the heating elements opposite the saddle, the reflector means cooperating with the saddle to provide at least one closed chamber for receipt of the heating elements.

14. The device according to claim 13 wherein a plurality of individual reflectors are provided with the heating elements adjacent the data carrier exit end being received within at least one reflector separate from the heating elements adjacent the data carrier entry end.

15. The device of claim 13 wherein the individual heating elements have substantially equal heating power, the spacing of the heating elements providing greater data carrier heating power adjacent the data carrier entry end than adjacent the data carrier exit end.

16. The device of claim 15 wherein the temperature of the saddle is maintained essentially constant from adjacent the data carrier entry end to adjacent the data carrier exit end.

17. The device for claim 15 wherein the sum of the heating powers of the heating elements is maximized adjacent the data carrier entry end and thereafter drops off continuously from the maximum point to the data carrier exit end.

* * * * *